US010568489B2

(12) United States Patent
Kim

(10) Patent No.: US 10,568,489 B2
(45) Date of Patent: Feb. 25, 2020

(54) DISH WASHING MACHINE

(71) Applicant: SAMSUNG ELECTRONICS CO., LTD., Suwon-si, Gyeonggi-do (KR)

(72) Inventor: Jin Doo Kim, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 178 days.

(21) Appl. No.: 15/442,015

(22) Filed: Feb. 24, 2017

(65) Prior Publication Data

US 2017/0245728 A1 Aug. 31, 2017

(30) Foreign Application Priority Data

Feb. 25, 2016 (KR) ..... 10-2016-0022710

(51) Int. Cl.
*A47L 15/42* (2006.01)
*A47L 15/16* (2006.01)

(52) U.S. Cl.
CPC ..... *A47L 15/4282* (2013.01); *A47L 15/16* (2013.01); *A47L 15/4246* (2013.01); *A47L 15/4251* (2013.01); *A47L 2401/00* (2013.01); *A47L 2401/30* (2013.01); *A47L 2501/20* (2013.01)

(58) Field of Classification Search
None
See application file for complete search history.

(56) References Cited

U.S. PATENT DOCUMENTS 2,236,791 A * 4/1941 Forsberg ..... A47L 15/18 134/172
4,301,688 A 11/1981 Salvati
5,230,665 A 7/1993 Tanaka et al.
2014/0345655 A1* 11/2014 Park ..... A47L 15/16 134/183
2015/0128999 A1* 5/2015 Park ..... A47L 15/16 134/25.2
2016/0316992 A1* 11/2016 Lee ..... A47L 15/0052

FOREIGN PATENT DOCUMENTS

| | | |
|---|---|---|
| JP | 5-1053 | 1/1993 |
| KR | 10-2015-0054610 | 5/2015 |
| KR | 10-2015-0064255 | 6/2015 |
| KR | 10-2015-0080383 | 7/2015 |

OTHER PUBLICATIONS

International Search Report dated May 25, 2017, in corresponding International Patent Application No. PCT/KR2017/001991.
European Office Action dated Sep. 17, 2018, in European Patent Application No. 17756817.7.

* cited by examiner

*Primary Examiner* — Cristi J Tate-Sims
(74) *Attorney, Agent, or Firm* — Staas & Halsey LLP

(57) ABSTRACT

Disclosed herein is a dish washing machine. The dish washing machine includes a washing tub in which dishes are stored, a nozzle provided at one side of the washing tub to spray washing water, a vane configured to move in the washing tub and deflect the washing water sprayed from the nozzle toward the dishes, a vane holder movably combined with a rail configured to guide a movement of the vane and configured to support the vane, a driving source configured to generate power for driving the vane to reciprocate, a belt driven to transfer the power generated by the driving source to the vane, and a direction changing member with one end configured to rotate with respect to the vane holder and another end configured to rotatably move with the belt when a movement direction of the vane is changed.

20 Claims, 17 Drawing Sheets

DISH WASHING MACHINE

CROSS-REFERENCE TO RELATED APPLICATIONS

This application claims the benefit of Korean Patent Application No. 10-2016-0022710, filed on Feb. 25, 2016 in the Korean Intellectual Property Office, the disclosure of which is incorporated herein by reference.

BACKGROUND

1. Field

The present disclosure relates to a dish washing machine, and more particularly, to a dish washing machine including a spraying nozzle fixed to one side thereof and a vane provided to be movable in a washing tub and configured to deflect washing water sprayed from the spraying nozzle toward dishes.

2. Description of the Related Art

A dish washing machine is a home appliance that includes a body with a washing tub provided therein, a basket for accommodating dishes, a sump configured to store washing water, a spraying nozzle configured to spray the washing water, and a pump configured to supply the washing water in the sump to the spraying nozzle and washes dishes by spraying washing water to dishes at high pressure.

Generally, dish washing machines each employ a rotor-type spraying structure having a spraying nozzle that rotates. A rotating nozzle sprays washing water while rotating due to water pressure. Since such rotating nozzle sprays the washing water only within a range in a radius of rotation, an area to which the washing water is not sprayed may occur. Accordingly, to prevent the occurrence of the area to which the washing water is not sprayed, a so-called linear type spraying structure has been provided.

The linear type spraying structure includes a fixed nozzle fixed to one side of a washing tub and a vane that moves inside the washing tub and deflects washing water sprayed from the fixed spraying nozzle toward dishes, thereby spraying the washing water to all areas of the washing tub according to the movement of a deflection plate.

The linear type spraying structure further includes a driving device capable of driving the vane. The driving device may be embodied in various types while including a controller configured to control driving of the vane to allow the vane to reciprocate. For example, the driving device may include the controller configured to control a position to drive the vane to reciprocate to control driving in one direction through time and to control driving in the other direction opposite to the one direction by checking a position of a sensor. Accordingly, a motor capable of rotating forward and backward to drive a vane to reciprocate and an additional controller for controlling the motor are necessary for a conventional driving device.

SUMMARY

It is an aspect of the present disclosure to provide a dish washing machine with a linear type spraying structure, capable of driving a vane to reciprocate without an additional controller.

It is another aspect of the present invention to provide a dish washing machine capable of driving a vane to reciprocate through a relatively simple configuration.

It is still another aspect of the present invention to provide a dish washing machine capable of detecting a malfunction of a vane.

It is yet another aspect of the present invention to provide a dish washing machine including a driving device with a low-priced belt improved in productivity and quality.

Additional aspects of the present disclosure will be set forth in part in the description which follows and, in part, will be obvious from the description, or may be learned by practice of the present disclosure.

In accordance with one aspect of the present disclosure, a dish washing machine includes a washing tub in which dishes are stored, a nozzle provided at one side of the washing tub to spray washing water, a vane configured to move in the washing tub and deflect the washing water sprayed from the nozzle toward the dishes, a vane holder movably combined with a rail configured to guide a movement of the vane and configured to support the vane, a driving source configured to generate power for driving the vane to reciprocate, a belt driven to transfer the power generated by the driving source to the vane, and a direction changing member with one end configured to rotate with respect to the vane holder and another end configured to rotatably move with the belt when a movement direction of the vane is changed.

The direction changing member may include a rotating pin provided at the one end and rotatably combined with the vane holder, a fixed portion provided at the another end and fixed to the belt, and a rotating portion configured to connect the fixed portion to the rotating pin.

The direction changing member may be formed to be integrated with the belt.

The belt may include a linear movement section and a rotational movement section.

In the rotational movement section of the belt, the direction changing member may be provided to rotate with respect to the vane with a center of a rotational movement of the belt as a rotation axis.

The direction changing member may move the vane in the linear movement section of the belt.

A driving gear unit may include a first gear connected to the driving source, and a second gear connected to the first gear and configured to receive the power generated by the driving source and rotate the belt.

The driving source may include a unidirectional rotation motor.

The dish washing machine may further include a sensor configured to sense whether the vane normally operates.

The vane may include a magnet accommodation portion that accommodates a magnet, and wherein the sensor may include a hall sensor configured to sense the magnet.

The sensor may be provided close to the nozzle.

The belt may include a plurality of power transfer portions, a wire configured to connect some of the plurality of power transfer portions to one another, and a connection member configured to connect other of the plurality of power transfer portions.

The plurality of power transfer portions may include concave portions rotatably combined with the connection member.

The direction changing member may be fixed to at least one of the plurality of power transfer portions.

The another end of the direction changing member may have a shape of the plurality of power transfer portions.

In accordance with another aspect of the present disclosure, a dish washing machine includes a washing tub in which dishes are stored, a nozzle fixed to one side of the washing tub to spray washing water, a vane configured to reciprocate in the washing tub and deflect the washing water sprayed from the nozzle toward the dishes, a driving source configured to generate power for driving the vane, a belt provided to transfer the power generated by the driving source to the vane and to comprise a linear movement section a rotational movement section, a direction changing member with one end rotatably connected to the vane and another end fixed to the belt and configured to connect the vane with the belt, and a sensor disposed close to a movement path of the vane to sense whether the vane deviates from the path, wherein the vane includes a magnet accommodation portion configured to accommodate a magnet sensed by the sensor.

The sensor may be provided close to the nozzle.

The dish washing machine may further include a driving gear unit and an idle gear configured to rotatably support the belt and provided in the rotational movement section of the belt, wherein in the rotational movement section of the belt, the one end of the direction changing member may rotate about rotational centers of the driving gear unit and the idle gear and the another end of the direction changing member may rotatably move along outer circumferences of the driving gear unit and the idle gear.

In accordance with still another aspect of the present disclosure, a dish washing machine includes a washing tub in which dishes are stored, a nozzle fixed to one side of the washing tub to spray washing water, a vane configured to reciprocate in the washing tub and deflect the washing water sprayed from the nozzle toward the dishes, a driving source configured to generate power for driving the vane, a belt connected to a driving gear unit and an idle gear to be rotatably driven to transfer the power generated by the driving source to the vane, and a direction changing member rotatably combined with the vane to rotate with respect to the vane when a movement direction of the vane is changed, wherein the belt includes a plurality of power transfer portions, a wire configured to connect some of the plurality of power transfer portions to one another, and a connection member configured to connect other of the plurality of power transfer portions to one another.

The connection member may include stainless steel.

BRIEF DESCRIPTION OF THE DRAWINGS

These and/or other aspects of the present disclosure will become apparent and more readily appreciated from the following description of the embodiments, taken in conjunction with the accompanying drawings of which.

DETAILED DESCRIPTION

Figure 1:
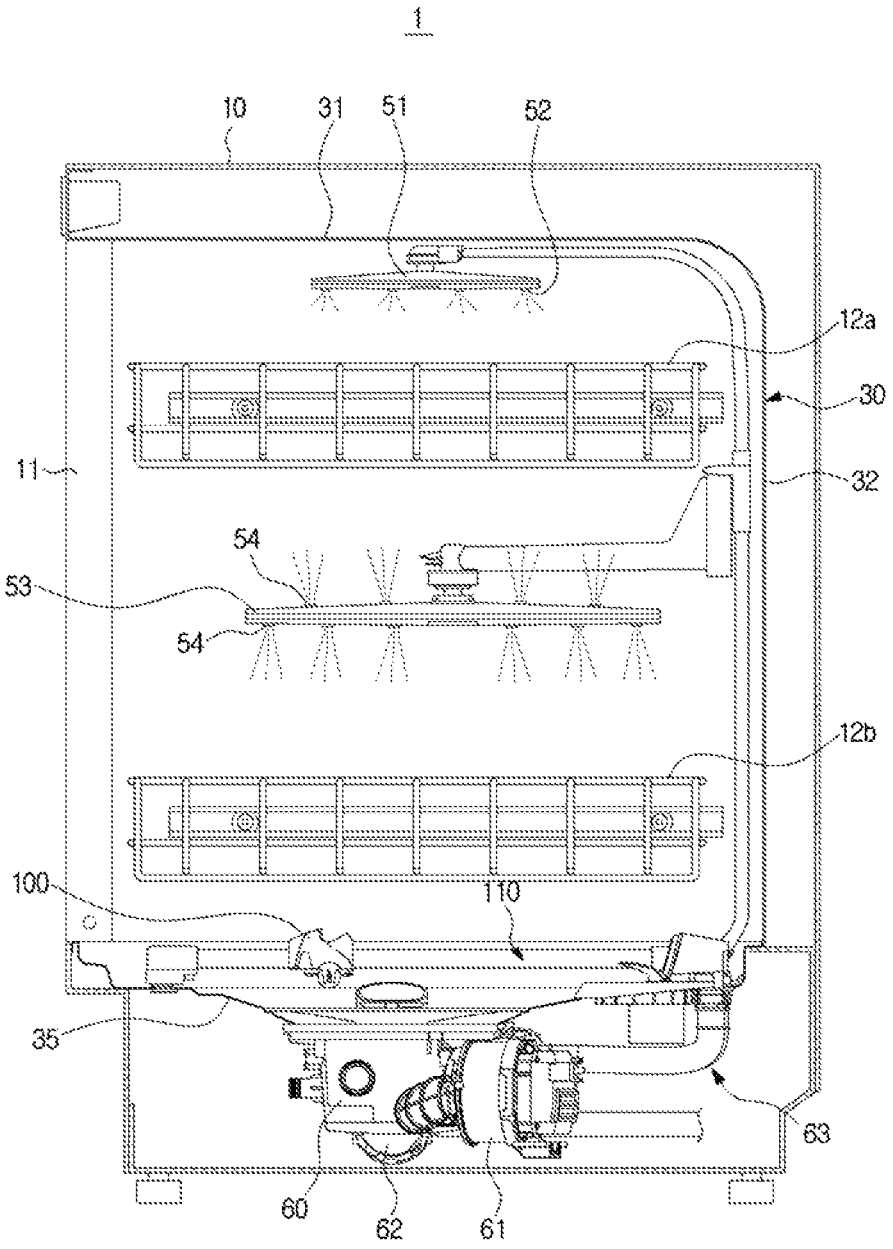
FIG. 1 is a schematic cross-sectional view of a dish washing machine according to one embodiment of the present disclosure.

Embodiments disclosed in the present specification and components shown in the drawings are merely preferable examples and various modifications capable of replacing the embodiments and drawings of the present specification may be made at the time of filing the present application.

Also, throughout the drawings of the present application, like reference numerals or symbols refer to components or elements configured to perform a substantially identical function.

Also, the terms used herein are to explain the embodiments but are not intended to limit and/or define the present disclosure. Singular forms, unless contextually otherwise defined, include plural forms. Throughout the specification, the terms "comprise", "have", etc. are used herein to specify the presence of stated features, numbers, steps, operations, elements, components or combinations thereof but do not preclude the presence or addition of one or more other features, numbers, steps, operations, elements, components, or combinations thereof.

Also, even though the terms including ordinals such as first, second and the like may be used for describing various components, the components will not be limited by the terms and the terms are used only for distinguishing one element from others. For example, without departing from the scope of the present invention, a first component may be referred to as a second component, and similarly, the second component may be referred to as the first component. The term "and/or" includes any and all combinations or one of a plurality of associated listed items.

Meanwhile, the terms "front end", "rear end", "above", "below", "top end", "bottom end", and the like used below are defined based on the drawings and shapes and positions of components are not limited thereto.

Hereinafter, the embodiments of the present disclosure will be described in detail with reference to the attached drawings.

Figure 2:
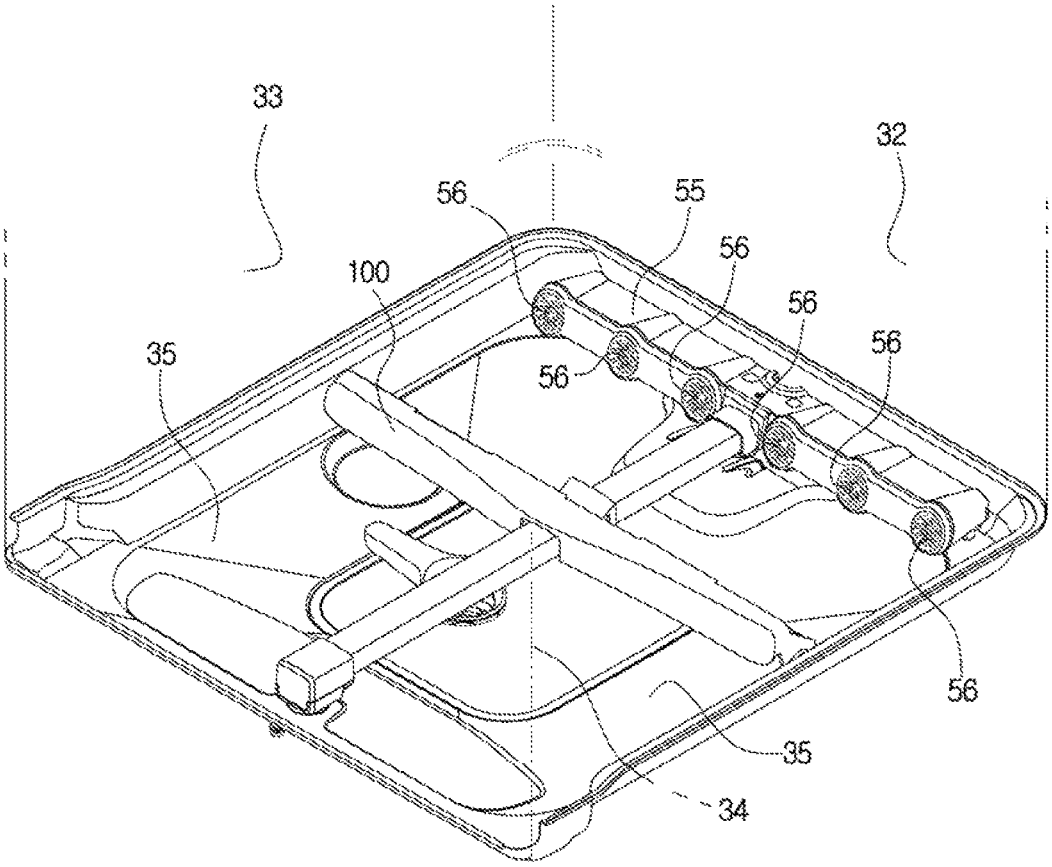
FIG. 2 is a bottom view of the dish washing machine shown in FIG. 1.

FIG. 1 is a schematic cross-sectional view of a dish washing machine 1 according to one embodiment of the present disclosure. FIG. 2 is a bottom view of the dish washing machine 1 shown in FIG. 1.

Referring to FIGS. 1 and 2, the dish washing machine 1 according to one embodiment of the present disclosure will be described The dish washing machine 1 may include a body 10 which forms an exterior, a washing tub 30 provided in the body 10, baskets 12*a* and 12*b* provided in the washing tub 30 to store dishes, spraying nozzles 51, 53, and 55 that spray washing water, a sump 60 that stores washing water, a circulation pump 61 that pumps and supplies the washing water in the sump 60 to the spraying nozzles 51, 53, and 55, a drain pump 62 that discharges the washing water in the sump 60 with food waste outward from the body 10, a vane 100 that deflects washing water toward dishes while moving in the washing tub 30, and a driving device 110 that drives the vane 100.

The washing tub 30 may have an approximate box shape with an open front to put in or out dishes. The open front of the washing tub 30 may be opened and closed by a door 11. The washing tub 30 may include a top wall 31, a rear wall 32, a left wall 33, a right wall 34, and a bottom plate 35.

The baskets 12*a* and 12*b* may be wire racks formed of wires to allow washing water not to stay and to pass therethrough. The baskets 12*a* and 12*b* may be detachably provided in the washing tub 30. The baskets 12*a* and 12*b* may include an upper basket 12*a* disposed on top of the washing tub 30 and a lower basket 12*b* disposed on bottom of the washing tub 30.

The spraying nozzles 51, 53, and 55 may wash dishes by spraying washing water at high pressure. The spraying nozzles 51, 53, and 55 may include an upper rotating nozzle 51 provided on top of the washing tub 30, an intermediate rotating nozzle 53 provided in the center of the washing tub 30, and a fixed nozzle 55 provided on bottom of the washing tub 30.

The upper rotating nozzle 51 may be provided above the upper basket 12*a* and may spray washing water downward while rotating due to water pressure. For this, spraying holes 52 may be provided at a bottom end of the upper rotating nozzle 51. The upper rotating nozzle 51 may directly spray washing water toward dishes stored in the upper basket 12*a*.

The intermediate rotating nozzle 53 may be provided between the upper basket 12*a* and the lower basket 12*b* and may spray washing water upward and downward while rotating due to water pressure. For this, spraying holes 54 may be provided at a top end and a bottom end of the intermediate rotating nozzle 53. The intermediate rotating nozzle 53 may directly spray washing water toward dishes stored in the upper basket 12*a* and the lower basket 12*b*.

The fixed nozzle 55 may be provided not to move and to be fixed to one side of the washing tub 30 unlike the rotating nozzles 51 and 53. The fixed nozzle 55 may be disposed approximately adjacent to the rear wall 32 of the washing tub 30 and may spray washing water toward the front of the washing tub 30. Accordingly, the washing water sprayed from the fixed nozzle 55 may not directly face dishes.

The washing water sprayed from the fixed nozzle 55 may be deflected by the vane 100 toward dishes. The fixed nozzle 55 may be disposed below the lower basket 12*b*, and the vane 100 may deflect the washing water sprayed from the fixed nozzle 55 upward. That is, the washing water sprayed from the fixed nozzle 55 may be deflected toward dishes stored in the basket 12*b* by the vane 100.

The fixed nozzle 55 may include a plurality of spraying holes 56 arranged on the left and right of the washing tub 30. The plurality of spraying holes 56 may spray washing water forward.

The upper rotating nozzle 51 and the intermediate rotating nozzle 53 may be combined with and fixed to the fixed nozzle 55.

The vane 100 may extend left and right of the washing tub 30 to deflect all the washing water sprayed from the plurality of spraying holes 56 of the fixed nozzle 55. That is, one longitudinal end of the vane 100 may be provided to be adjacent to the left wall 33 of the washing tub 30 and another longitudinal end of the vane 100 may be provided to be close to the right wall 34 of the washing tub 30.

The vane 100 may linearly reciprocate along a spraying direction of the washing water sprayed from the fixed nozzle 55. That is, the vane 100 may linearly reciprocate along a front-and-rear direction of the washing tub 30. Accordingly, a linear spraying structure including the fixed nozzle 55 and the vane 100 may wash the entire area of the washing tub 30 without a blind spot.

The dish washing machine 1 may include a water supply operation, a washing operation, a drain operation, and a drying operation.

In the water supply operation, washing water may be supplied into the washing tub 30 through a water supply pipe (not shown). The washing water supplied to the washing tub 30 may flow to the sump 60 provided at the bottom of the washing tub 30 due to a gradient of the bottom plate 35 of the washing tub 30 and may be stored in the sump 60.

In the washing operation, the circulation pump 61 is operated to pump the washing water of the sump 60. The washing water pumped by the circulation pump 61 may be distributed into the rotating nozzles 51 and 53 and the fixed nozzle 55 through a distributor (not shown). The washing water may be sprayed to wash dishes from the spraying nozzles 51, 53, and 55 at high pressure due to a pumping force of the circulation pump 61.

The washing water sprayed from the spraying nozzles 51, 53, and 55 hit dishes to remove food waste that remain on the dishes and fall with the food waste to be stored in the sump 60 again. The circulation pump 61 pumps again the washing water stored in the sump 60 to circulate. In the washing operation, the circulation pump 61 may repeat operating and stopping several times. In this process, the food waste falling with the washing water to the sump 60 is collected by a filter mounted on the sump 60, does not circulate through the spraying nozzles 51, 53, and 55, and remains at the sump 60.

In the drain operation, the drain pump 62 may be operated to discharge the food waste that remains at the sump 60 with the washing water outward from the body 10.

In the drying operation, a heater (not shown) mounted on the washing tub 30 may be operated to dry dishes.

Figure 3:
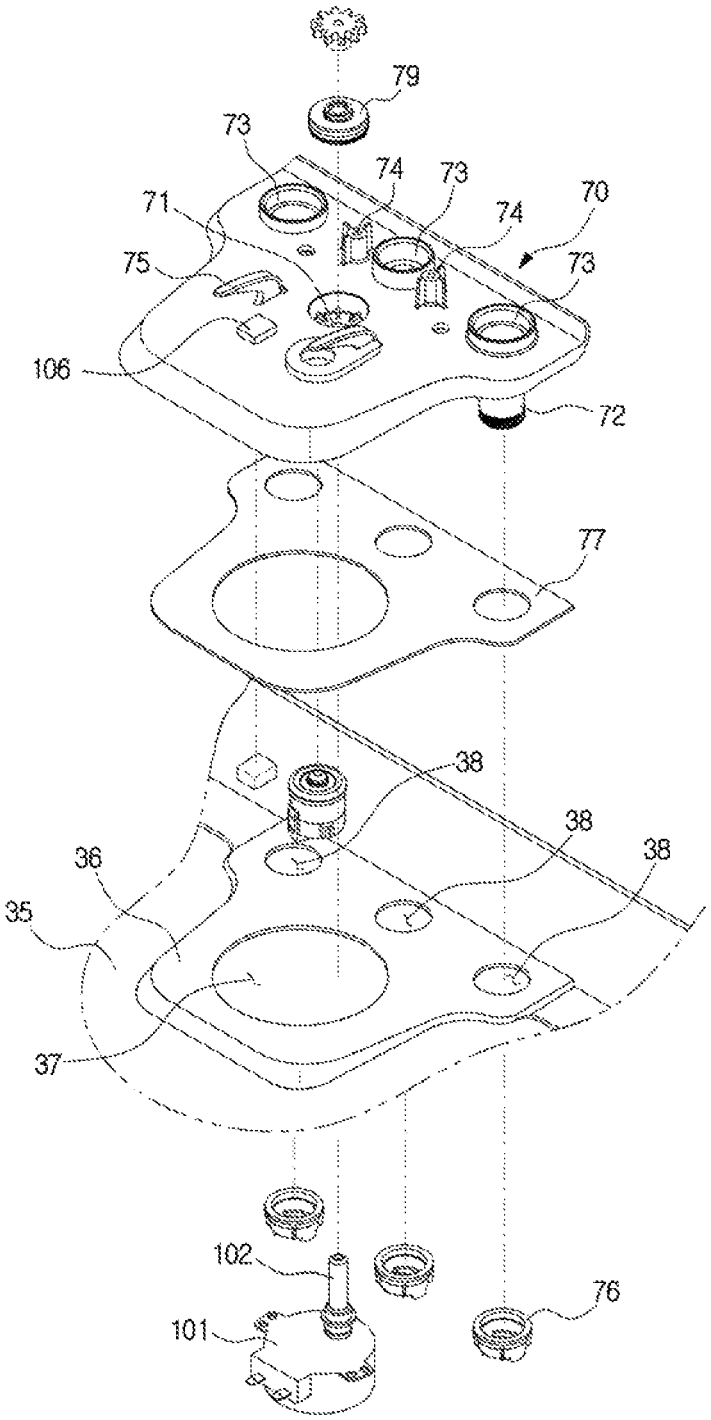
FIG. 3 is an exploded view illustrating the bottom plate of the washing tub, a bottom plate cover, and a driving source of the dish washing machine shown in FIG. 1.
Figure 4:
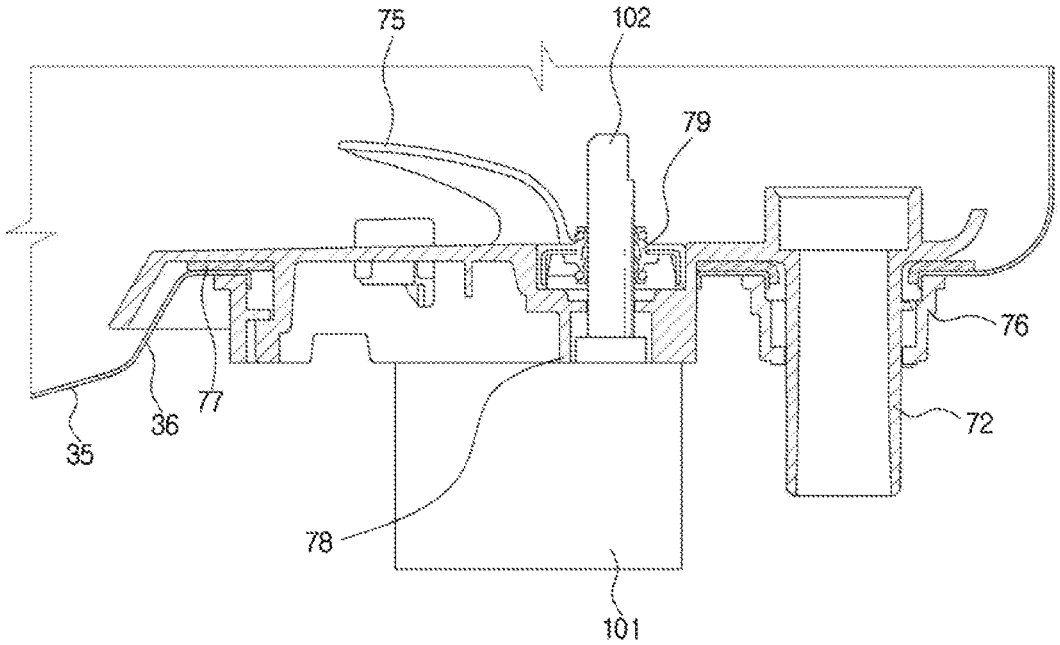
FIG. 4 is a cross-sectional view illustrating the bottom plate, the bottom plate cover, and the driving source of the dish washing machine shown in FIG. 1.
Figure 5:
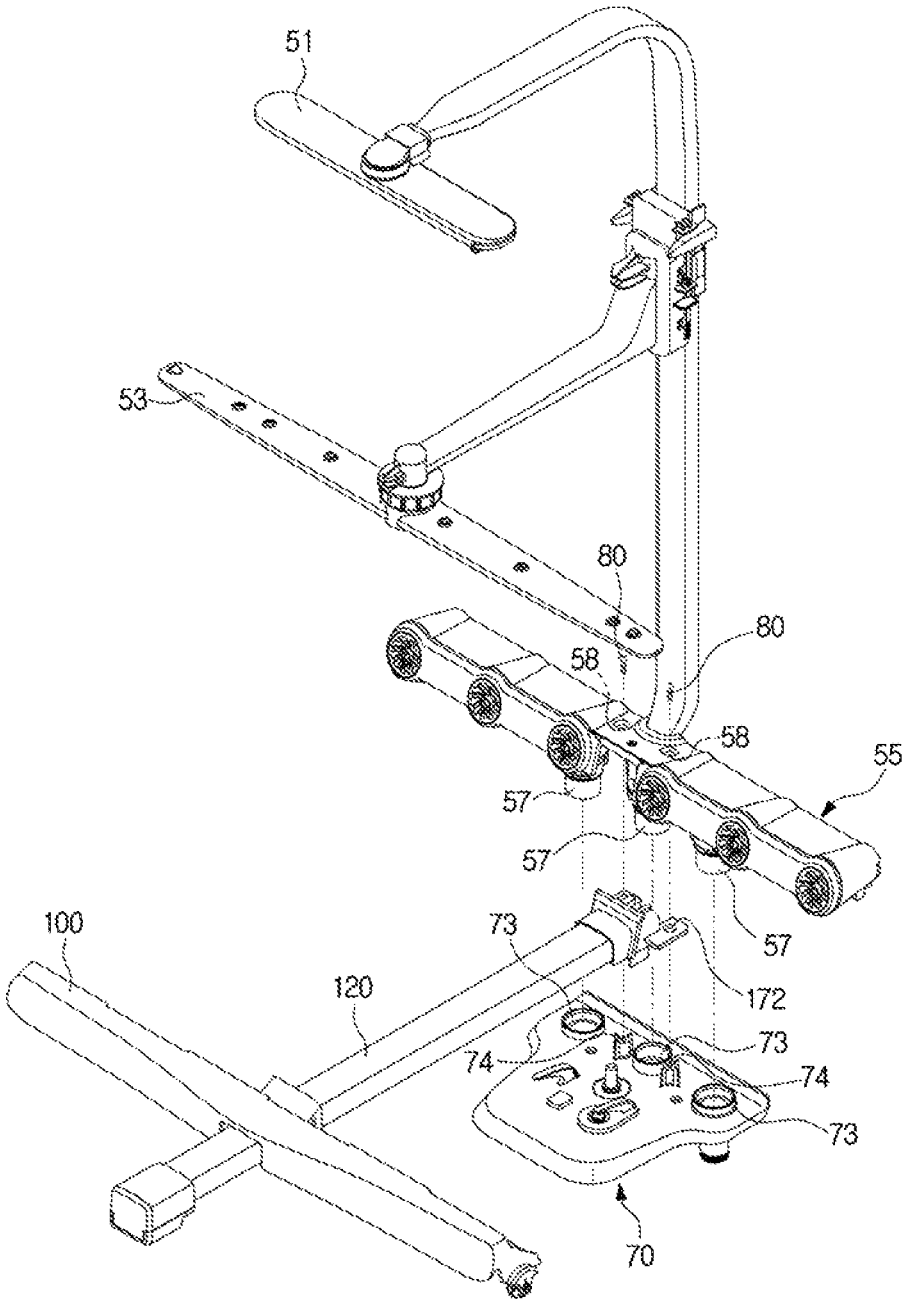
FIG. 5 is an exploded view illustrating the vane, a rail assembly, the spraying nozzles and the bottom plate cover of the dish washing machine shown in FIG. 1.

FIG. 3 is an exploded view illustrating the bottom plate 35 of the washing tub 30, a bottom plate cover 70, and a driving source 101 of the dish washing machine 1 shown in FIG. 1. FIG. 4 is a cross-sectional view illustrating the bottom plate 35, the bottom plate cover 70, and the driving source 101 of the dish washing machine 1 shown in FIG. 1. FIG. 5 is an exploded view illustrating the vane 100, a rail assembly 120, the spraying nozzles 51, 53, and 55, and the bottom plate cover 70 of the dish washing machine 1 shown in FIG. 1.

Referring to FIGS. 3 and 5, the bottom plate cover 70 of the dish washing machine 1 according to one embodiment of the present disclosure will be described.

The dish washing machine 1 may include the bottom plate cover 70 combined with one rear side of the bottom plate 35 of the washing tub 30.

The bottom plate cover 70 performs a function of sealing a driving source through hole 37 and flow channel through holes 38 formed at the bottom plate 35, a function of supporting the driving source 101 that drives the vane 100, and a function of fixing the rail assembly 120 and the spraying nozzles 51, 53, and 55 of the dish washing machine 1.

The rail assembly 120 guides a movement of the vane 100 and a detailed configuration thereof will be described below.

A bottom plate protruding portion 36 that protrudes to be combined with the bottom plate cover 70 may be formed in the rear of the bottom plate 35. The driving source through hole 37 through which the driving source 101 for driving the vane 100 passes and the flow channel through holes 38 through which flow channels that connect the spraying nozzles 51, 53, and 55 with the distributor pass may be formed at the bottom plate protruding portion 36.

The driving source 101 may be mounted on a bottom surface of the bottom plate cover 70 and may be withdrawn with the bottom plate cover 70 through the driving source through hole 37 when the bottom plate cover 70 is separated from the bottom plate 35.

In detail, hose connection portions 72 of the bottom plate cover 70 may pass through the flow channel through holes 38.

The bottom plate cover 70 may include a shaft through hole 71 through which a driving shaft 102 of the driving source 101 passes, the hose connection portions 72 configured to protrude downward to be combined with hoses 63 that extend from the distributor and inserted into the flow channel through holes 38 of the bottom plate protruding portion 36, nozzle inlet connection portions 73 configured to protrude upward to be combined with inlets 57 of the spraying nozzles 51, 53, and 55, fastening holes 74 for fixing the fixed nozzle 55 and the rail assembly 120, and a rotation guide 75 that protrudes to guide rotation of the vane 100.

The bottom plate cover 70 is tightly combined with a top surface of the bottom plate protruding portion 36. Fixing caps 76 may be combined with the hose connection portions 72 of the bottom plate cover 70 to fix the bottom plate cover 70 to the bottom plate protruding portion 36.

A sealing member 77 may be provided between the bottom plate cover 70 and the bottom plate protruding portion 36 to prevent washing water in the washing tub 30 from leaking through the driving source through hole 37 and the flow channel through holes 38 of the bottom plate protruding portion 36. The sealing member 77 may be formed of rubber.

A driving source mounting portion 78 on which the driving source 101 configured to drive the vane 100 is mounted may be provided on the bottom surface of the bottom plate cover 70. The driving shaft 102 of the driving source 101 may pass through the shaft through hole 71 of the bottom plate cover 70 and may protrude into the washing tub 30. A driving gear unit 130 described below may be combined with the driving shaft 102 of the driving source 101 and may rotate with the driving shaft 102.

A sealing member 79 may be provided at the shaft through hole 71 to prevent washing water in the washing tub 30 from leaking through the shaft through hole 71. The sealing member 79 may be a mechanical sealing device configured to allow the driving shaft 102 to smoothly rotate and simultaneously with sealing.

The rail assembly 120 and the fixed nozzle 55 may be combined with the bottom plate cover 70. The bottom plate cover 70, the rail assembly 120, and the fixed nozzle 55 may be strongly fixed by a fastening member 80. For this, fastening holes 74, 58, and 172 may be formed at corresponding positions of the bottom plate cover 70, the fixed nozzle 55, and the rail assembly 120, respectively.

Through this structure described above, the rail assembly 120 and the fixed nozzle 55 may be fixed to each other and mutually aligned.

The bottom plate cover 70 may further include a sensor 106 configured to sense whether the vane 100 normally operates. The sensor 106 may check and transfer whether the vane 100 is normally driven on a rail 121 to a controller (not shown), and the controller may stop driving of the dish washing machine 1 when the vane 100 malfunctions. As an example, when the vane 100 deviates from the rail 121, the sensor 106 may determine that the vane 100 malfunctions and inform the controller about it and the controller may stop driving of the dish washing machine 1 to stop spraying of the spraying nozzles 51, 53, and 55. According to this configuration described above, a water leakage and noise may be prevented, thereby stably using the dish washing machine 1.

The sensor 106 may be a hall sensor capable of sensing a magnet provided at the vane 100 that will be described below but is not limited thereto and an optical sensor, a pressure sensor and the like may be used. The sensor 106 may be provided to be disposed close to the fixed nozzle 55 and to sense whether the vane 100 moves toward the fixed nozzle 55.

In the dish washing machine 1 according to one embodiment of the present disclosure, since washing water sprayed from the fixed nozzle 55 does not directly face dishes and is deflected by the vane 100 combined with the rail assembly 120 to face the dishes, it is necessary to precisely align positions of the fixed nozzle 55 and the rail assembly 120. Accordingly, this need may be satisfied through such combination structure described above.

Figure 6:
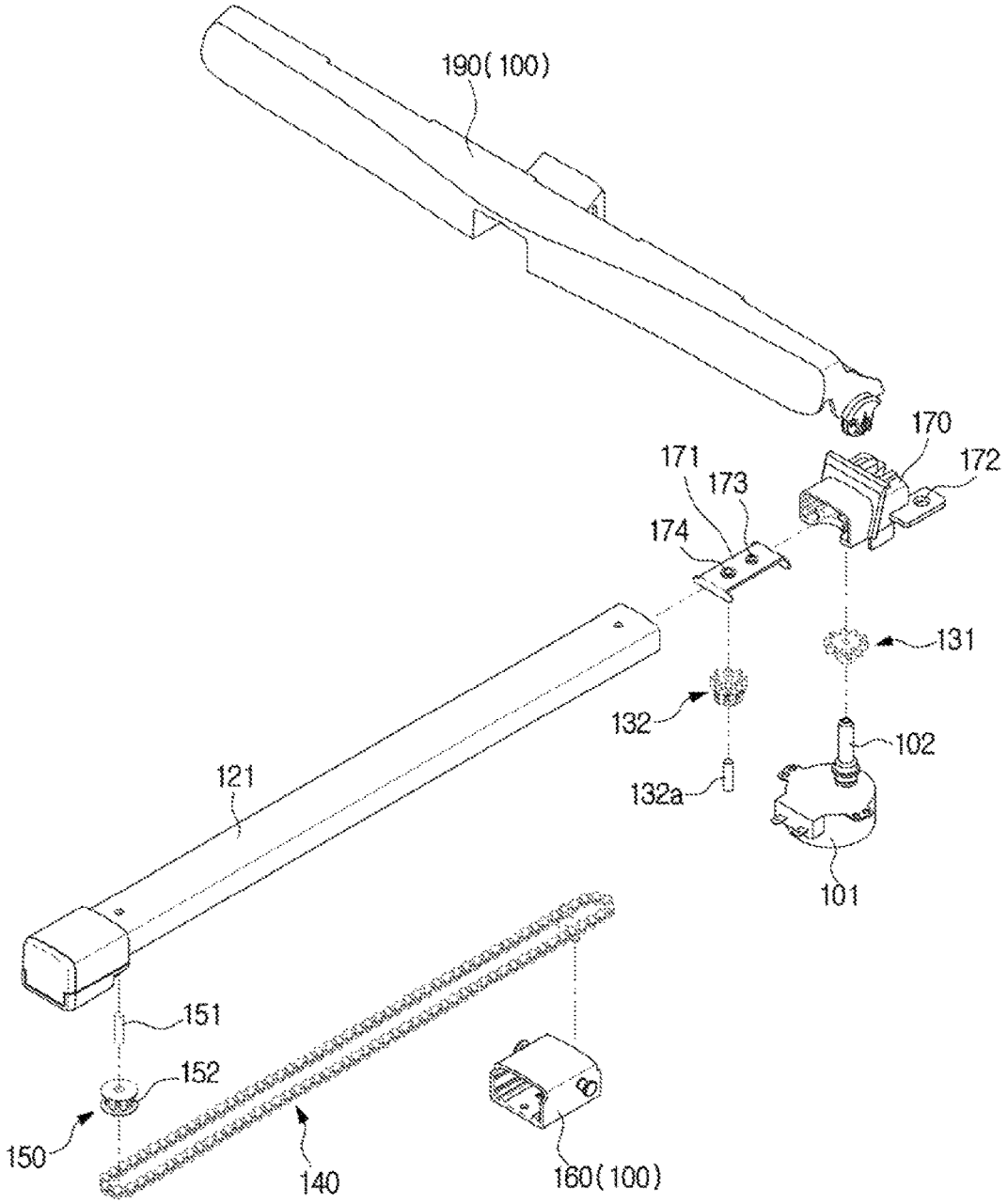
FIG. 6 is a view illustrating the vane and the driving device of the dish washing machine shown in FIG. 1, in which components of the driving device and a vane holder are disassembled.
Figure 7:
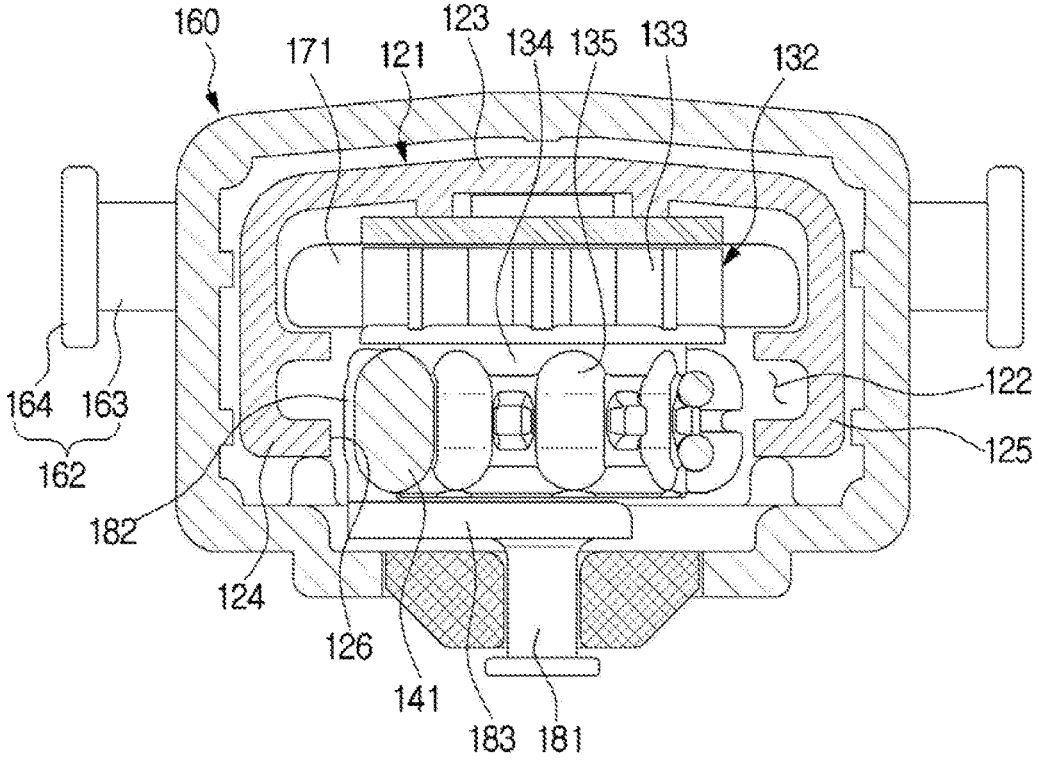
FIG. 7 is a cross-sectional view illustrating the rail, a belt, the vane holder, and the driving gear unit of the dish washing machine shown in FIG. 1.
Figure 8:
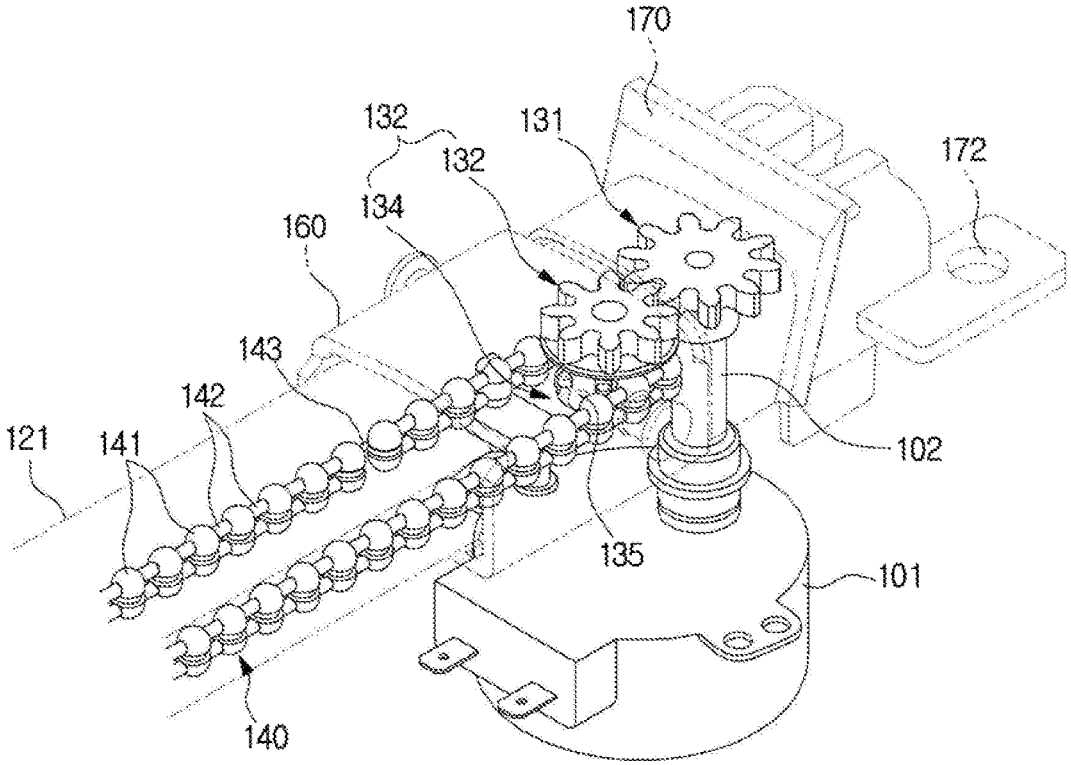
FIG. 8 is a view illustrating the driving gear unit of the dish washing machine shown in FIG. 1.
Figure 9:
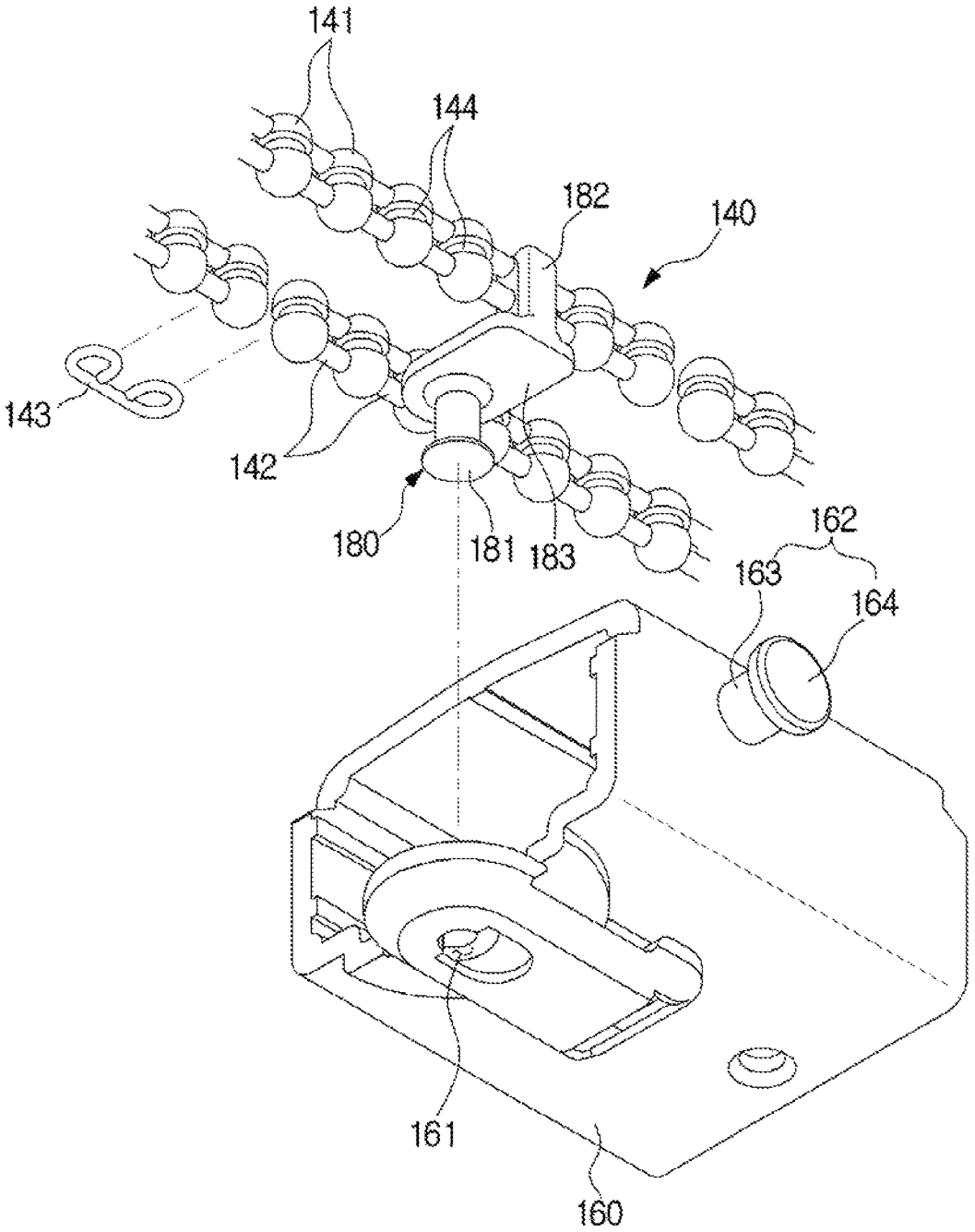
FIG. 9 is a view illustrating the belt and the vane holder of the dish washing machine shown in FIG. 1.

FIG. 6 is a view illustrating the vane 100 and the driving device 110 of the dish washing machine 1 shown in FIG. 1, in which components of the driving device 110 and a vane holder 160 are disassembled. FIG. 7 is a cross-sectional view illustrating the rail 121, a belt 140, the vane holder 160, and the driving gear unit 130 of the dish washing machine 1 shown in FIG. 1. FIG. 8 is a view illustrating the driving gear unit 130 of the dish washing machine 1 shown in FIG. 1. FIG. 9 is a view illustrating the belt 140 and the vane holder 160 of the dish washing machine 1 shown in FIG. 1.

The dish washing machine 1 includes the vane 100 configured to deflect washing water sprayed form the fixed nozzle 55. The vane 100 may linearly reciprocate along a spraying direction of the washing water sprayed from the fixed nozzle 55. The dish washing machine 1 includes the driving device 110 for allowing the vane 100 to linearly reciprocate.

The driving device 110 includes the driving source 101 configured to generate a driving force and the rail assembly 120 configured to guide the movement of the vane 100.

The rail assembly 120 includes the rail 121 configured to guide the movement of the vane 100 and have an internal space 122, the driving gear unit 130 connected to the driving source 101 to rotate, the belt 140 connected to the driving gear unit 130 to rotate and disposed in the internal space 122 of the rail 121, an idle gear 150 connected to the belt 140 to rotatably support the belt 140, a rear holder 170 configured to rotatably support the driving gear unit 130 and combined with a rear end of the rail 121, and a direction changing member 180 configured to change a movement direction of the vane 100.

The rail 121 may be formed of a metal material. The rail 121 may be provided to elongate in a front-and-rear direction in an approximate center based on the left wall 33 and the right wall 34 of the washing tub 30.

The rail 121 may have a tube shape with an opening 126 at an approximate bottom thereof. That is, the rail 121 may include the internal space 122, an upper wall 123, a lower wall 124, both side walls 125, and the opening 126 formed at the lower wall 124. The opening 126 may extend from one end of the rail 121 in a longitudinal direction toward another end opposite to the one end. According to such configuration, the belt 140 disposed in the internal space 122 of the rail 121 and the vane 100 provided outside the rail 121 are connected to transfer the driving force of the belt 140 to the vane 100.

The driving gear unit 130 may include a first gear 131 connected to the driving shaft 102 of the driving source 101 and a second gear 132 configured to rotate while engaged with the first gear 131 and connected to the belt 140 to rotate the belt 140.

The first gear 131 is connected to the driving shaft 102 and rotates due to power generated by the driving source 101. The first gear 131 may include gear teeth provided on an outer circumferential surface thereof to be engaged with the second gear 132 to rotate.

The second gear 132 may rotate about a rotating shaft 132*a* and may include a first connection portion 133 with gear teeth to be engaged with the first gear 131 and rotate and a second connection portion 134 connected to the belt 140 to rotate the belt 140. The second connection portion 134 may be provided as a shape corresponding to that of an inner surface of the belt 140 to reduce a power loss by rotating the belt 140 without slip. That is, the second connection portion 134 may be provided to include a power transfer portion accommodating groove 135 formed corresponding to a plurality of power transfer portions 141 that will be described below and to come into contact with an inner circumferential surface of the belt 140.

The belt 140 may be wound on the driving gear unit 130 and the idle gear 150 to form a closed curve and may rotate according to a rotation direction of the driving source 101 when the driving source 101 is driven. The belt 140 may include the plurality of power transfer portions 141 engaged with the second gear 132, a wire 142 configured to connect some of the plurality of power transfer portions 141 to one another, and a connection member 143 configured to connect others of the plurality of power transfer portions 141 to one another.

The plurality of power transfer portions 141 may have approximate bead shapes. The plurality of power transfer portions 141 described above may be provided to come into approximate surface contact with the power transfer portion accommodating groove 135 provided at the second connection portion 134 of the second gear 132. That is, the belt 140 may be engaged with the second gear 132 through the plurality of power transfer portions 141 and rotate with the second gear 132.

Figure 10:
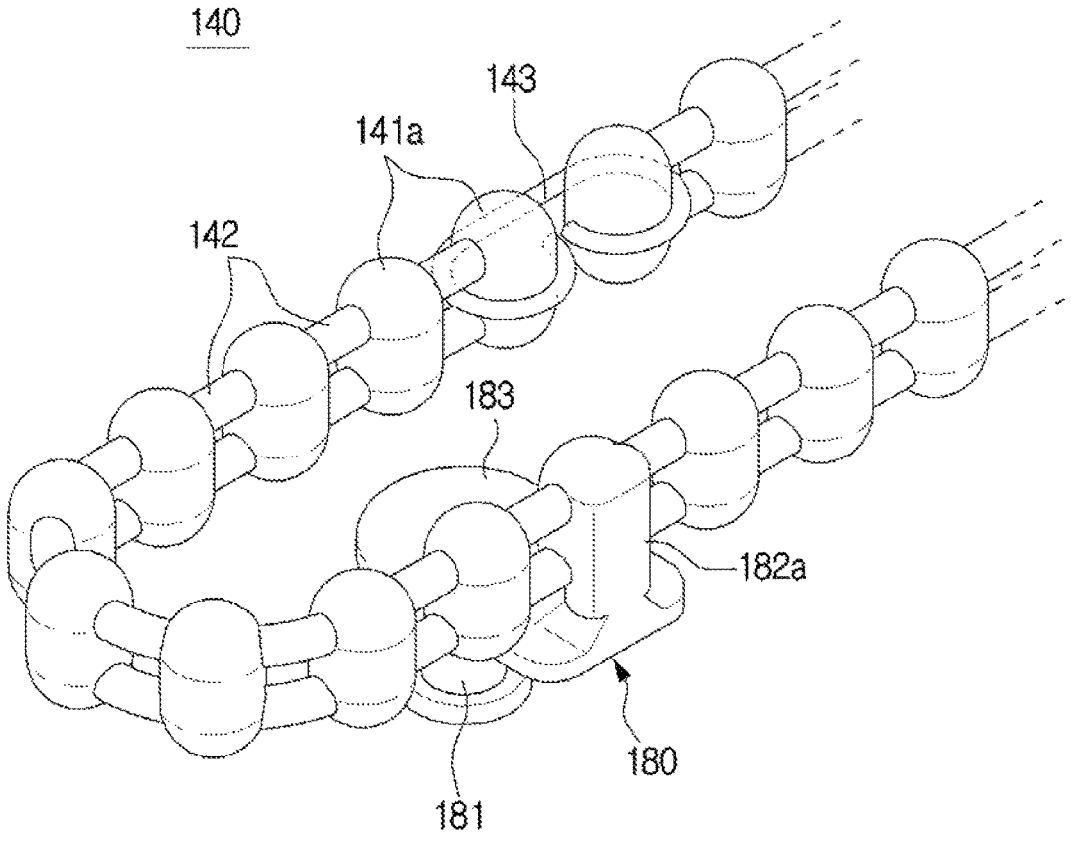
FIG. 10 is a view illustrating another embodiment of the belt shown in FIG. 9.

The plurality of power transfer portions 141 may include concave portions 144 to which the connection member 143 that will be described below is rotatably connected. Unlike this, as shown in FIG. 10, power transfer portions 141*a* may not include concave portions. In this case, the connection member 143 may be rotatably combined with outer surfaces of the plurality of power transfer portions 141*a*.

The wire 142 connects some of the plurality of power transfer portions 141 to one another. In detail, the wire 142 may connect other power transfer portions 141 than the power transfer portions 141 connected through the connection member 143 that will be described below. In FIG. 9, two wires 142 connect the plurality of power transfer portions 141 but are not limited thereto. One wire may connect a plurality of power transfer portions, or three or more wires may be used to connect a plurality of power transfer portions.

The plurality of power transfer portions 141 and the wires 142 may be integrated. In detail, the plurality of power transfer portions 141 and the wires 142 may be injection molded to be integrated.

The plurality of power transfer portions 141 and the wires 142 may be injection-molded to be integrated in an approximately linear shape not a closed curve. That is, the plurality of power transfer portions 141 and the wires 142 may be injection-molded to have repeatedly arranged and elongated shapes with both ends. In this case, the both ends of the plurality of power transfer portions 141 and the wires 142 formed in approximately linear shapes may be connected through the connection member 143. That is, the plurality of power transfer portions 141 and the wires 142 provided to be integrated in the approximately linear shape not a closed curve may be formed in a closed curve by rotatably connecting the power transfer portions 141 disposed at both ends to each other through the connection member 143.

The connection member 143 may rotatably connect some of the plurality of power transfer portions 141 to each other. In detail, to adjust the entire length of the belt 140, a combination of the plurality of power transfer portions 141 and the wires 142 injection-molded to be repeatedly arranged and elongated as described above may be formed in a closed curve by connecting a plurality thereof to each other through the connection member 143.

The connection member 143 described above may be provided to include stainless steel with high strength.

As described above, when the belt 140 is manufactured by injection-molding the plurality of power transfer portions 141 and the wires 142 as a single body and preparing the same by a necessary length to connect through the connection member 143, productivity is increased and manufacturing costs are reduced. In addition, strength may increase compared with general belts formed by connecting using a welding method and the like and quality may improved.

The rear holder 170 rotatably supports the driving gear unit 130 and is combined with the rear end of the rail 121. The rear holder 170 may include a supporting plate 171 configured to rotatably support the driving gear unit 130 and the fastening hole 172 for being combined with the bottom plate cover 70.

The supporting plate 171 may include a first gear hole 173 configured to rotatably support a shaft of the first gear 131 and a second gear hole 174 configured to rotatably support a shaft of the second gear 132.

The idle gear 150 includes a rotation shaft 151 and a belt combining portion 152 combined with the belt 140.

One end of the direction changing member 180 may be rotatably combined with the vane 100 and the other end thereof may be fixed to the belt 140. The direction changing member 180 may allow the vane 100 to change the movement direction thereof and to reciprocate in the washing tub 30 even though the belt 140 rotates in only one direction. The direction changing member 180 may include a rotating pin 181 rotatably combined with the vane 100, a fixed portion 182 fixed to the belt 140, and a rotating portion 183 configured to connect the rotating pin 181 with the fixed portion 182.

The rotating pin 181 is provided at one end of the direction changing member 180 and is rotatably combined with the vane 100. The rotating pin 181 may not rotate and linearly move along the belt 140 when the vane 100 linearly moves and may rotate with respect to the vane 100 to allow the vane 100 not to move in position and to remain in place when the vane 100 changes the movement direction.

The fixed portion 182 is provided at another end of the direction changing member 180 and fixed to the belt 140 to rotate with the belt 140. The fixed portion 182 may be disposed on an outer surface of the belt 140 not to interfere rotation of the belt 140 when the belt 140 passes through the driving gear unit 130 or the idle gear 150. In detail, the fixed portion 182 may be fixed to at least one of the plurality of power transfer portions 141. Unlike this, the fixed portion 182 may be fixed to the wire 142.

The rotating portion 183 connects the rotating pin 181 and the fixed portion 182. The rotating portion 183 may extend from the fixed portion 182 toward the rotating pin 181 that is a rotational center of the direction changing member 180. Accordingly, the other end of the rotating portion 183 close to the fixed portion 182 is rotatably driven about one end close to the rotating pin 181 when the belt 140 passes through the driving gear unit 130 or the idle gear 150.

The direction changing member 180 described above, may be provided separately from the belt 140 as shown in FIG. 9 or may be provided to be integrated with the belt 140 as shown in FIG. 10. In this case, a fixed portion 182*a* of the direction changing member 180 is provided in an approximately same shape as those of the power transfer portions 141 or 141*a*. That is, the fixed portion 182*a* may be provided in a shape corresponding to an outer circumferential surface of the second gear 132 and may be configured to be engaged with the second gear 132. Accordingly, when the direction changing member 180 passes through the second gear 132 or the idle gear 150, the fixed portion 182*a* may be rotatably driven along the outer circumferential surface of the second gear 132 or the idle gear 150. When the belt 140 and the direction changing member 180 are formed to be integrated as described above, power of the driving source 101 may be more stably transferred to the vane 100.

According to such configuration described above, the direction changing member 180 may change the movement direction of the vane 100 while passing through the second gear 132 of the driving gear unit 130 or the idle gear 150 during a process of moving along the belt 140. Here, a radius of rotational driving of the fixed portion 182 about the rotating pin 181 of the direction changing member 180 is approximately similar to a radius of the second gear 132 of the driving gear unit 130 or the idle gear 150.

FIGS. 11 to 14 are views sequentially illustrating a movement process of the vane 100 of the dish washing machine 1 shown in FIG. 1.

Referring to FIGS. 11 to 14, a process of changing the movement direction of the vane 100 will be described in detail. However, FIGS. 11 to 14 illustrate only a process in which the direction changing member 180 passes through the second gear 132 of the driving gear unit 130. Since a case in which the direction changing member 180 passes through the idle gear 150 is identical to the case of passing through the second gear 132, a detailed description will be omitted.

Figure 11:
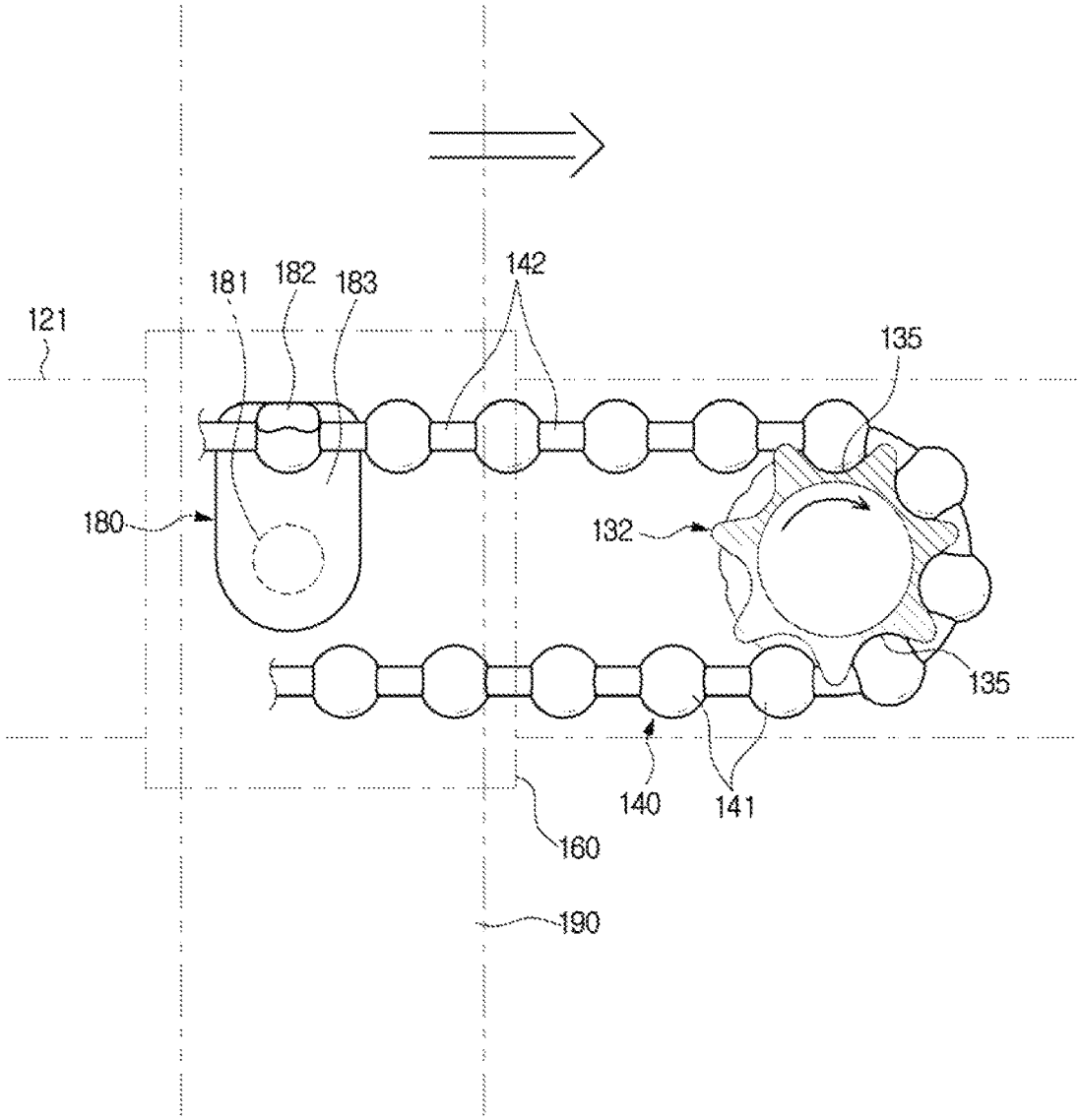
FIGS. 11 to 14 are views sequentially illustrating a movement process of the vane of the dish washing machine shown in FIG. 1.

Referring to FIG. 11, when the direction changing member 180 linearly moves with the belt 140, the vane 100 linearly moves with the belt 140.

Figure 12:
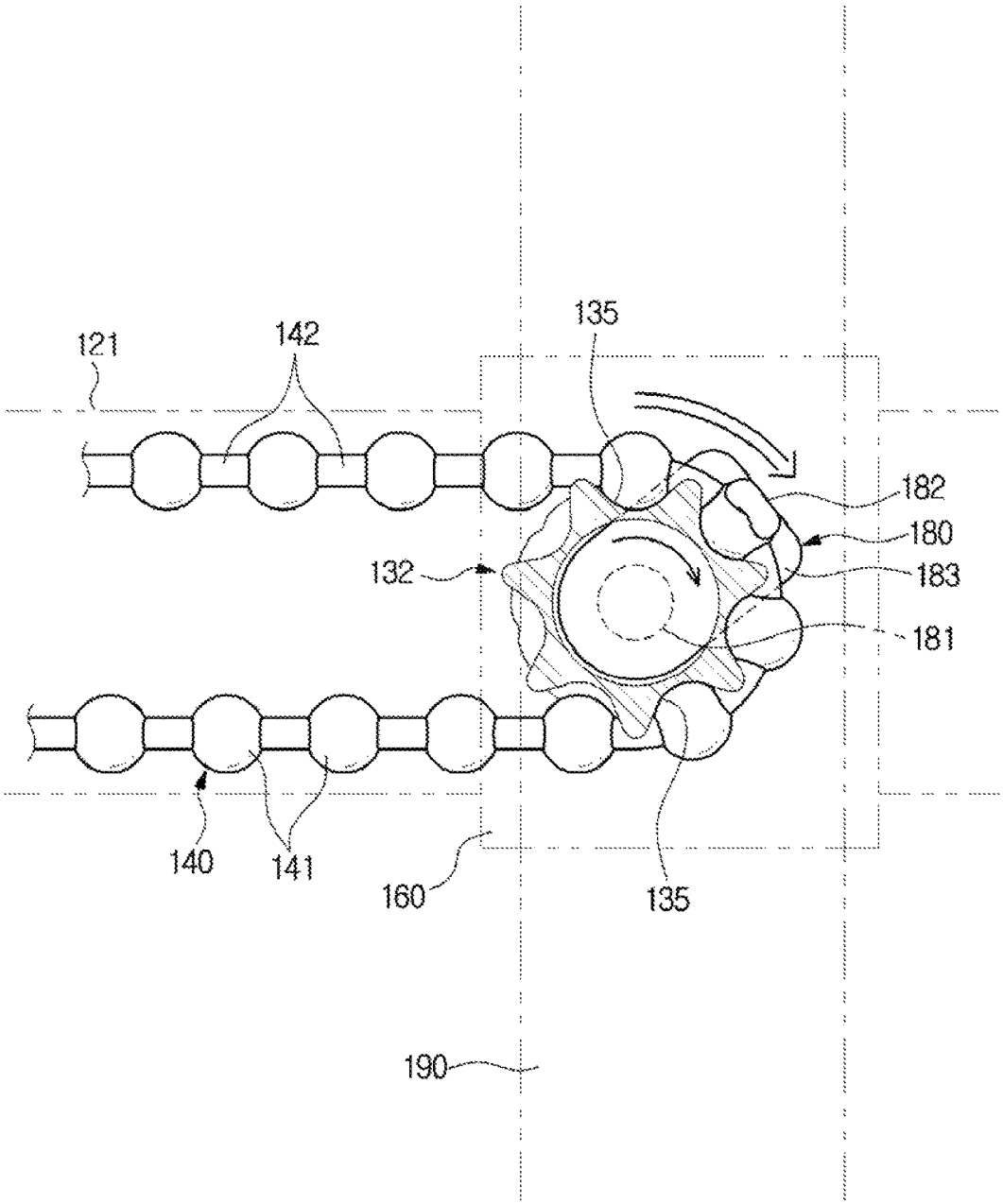
Figure 13:
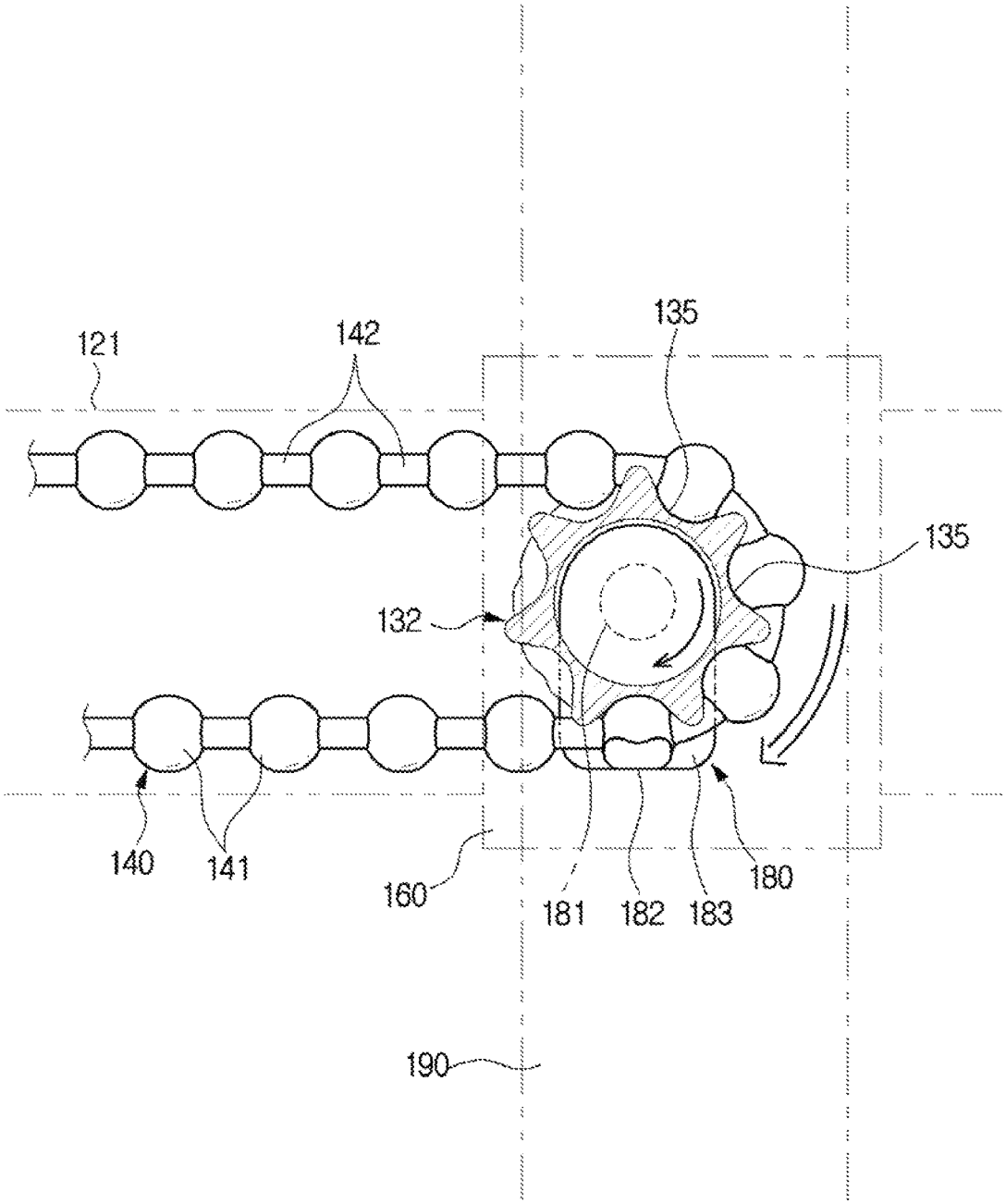

On the other hand, referring to FIGS. 12 and 13, when the direction changing member 180 passes through the second gear 132 or the idle gear 150, the rotating pin 181 connected to the vane 100 only rotates and does not move in position and only the fixed portion 182 rotatably moves with the belt 140 along the outer circumferential surface of the second gear 132 or the idle gear 150. Accordingly, in a situation like FIGS. 11 and 12, the vane 100 temporarily stops while the fixed portion 182 rotatably moves.

Figure 14:
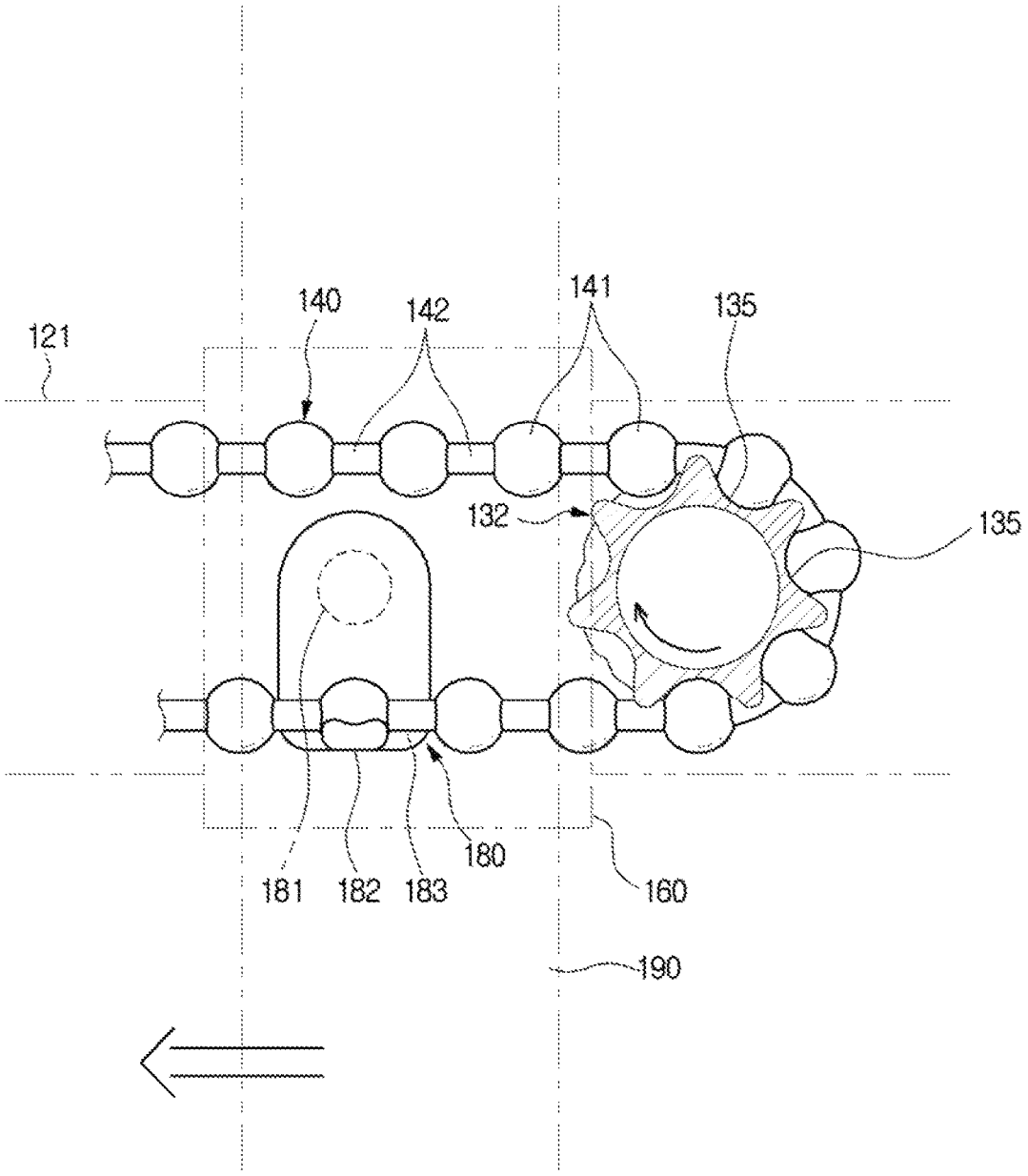

After that, referring to FIG. 14, after the direction changing member 180 passes through the second gear 132 or the idle gear 150, the vane 100 linearly moves in a direction opposite to a direction shown in FIG. 11.

Due to such configuration described above, the dish washing machine 1 shown in FIG. 1 may change the movement direction of the vane 100 even though the driving source 101 that is relatively cheap and rotatable in one direction is used, thereby reducing manufacturing costs.

Figure 15:
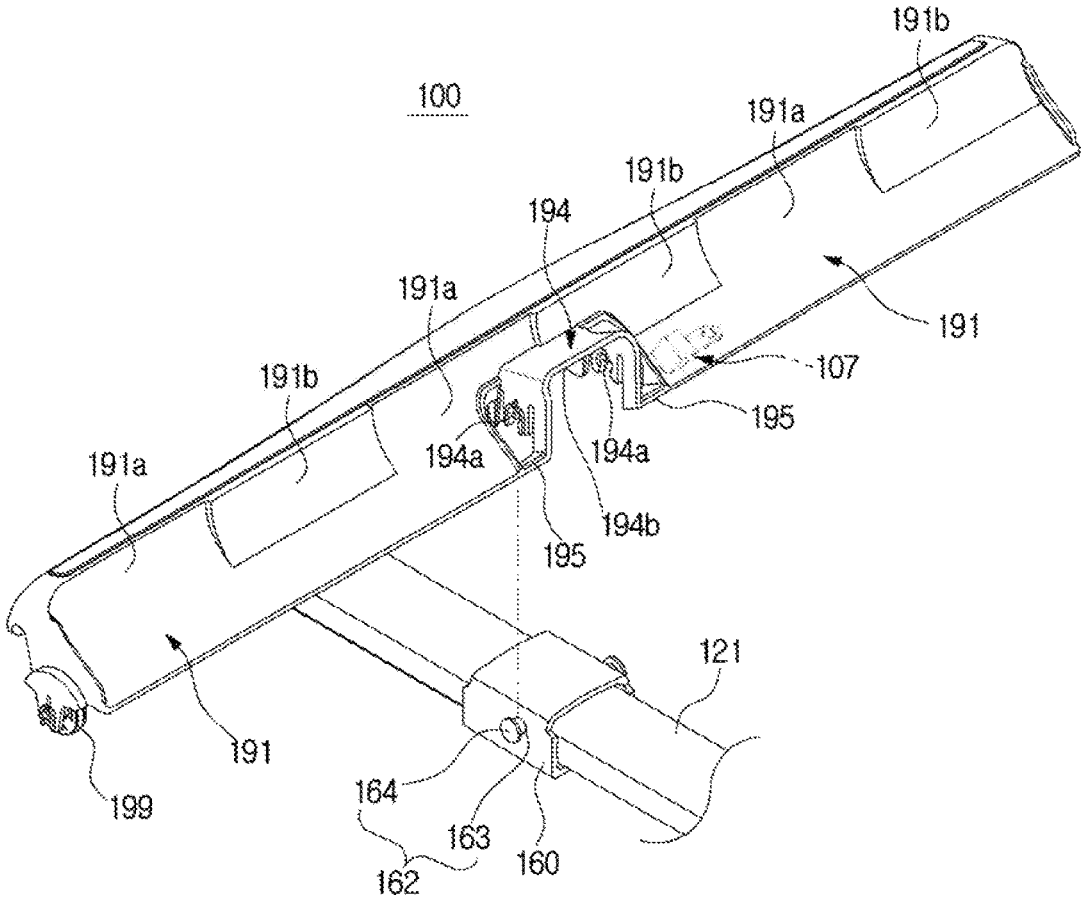
FIG. 15 is a view illustrating a deflection member and the vane holder of the dish washing machine shown in FIG. 1.
Figure 16:
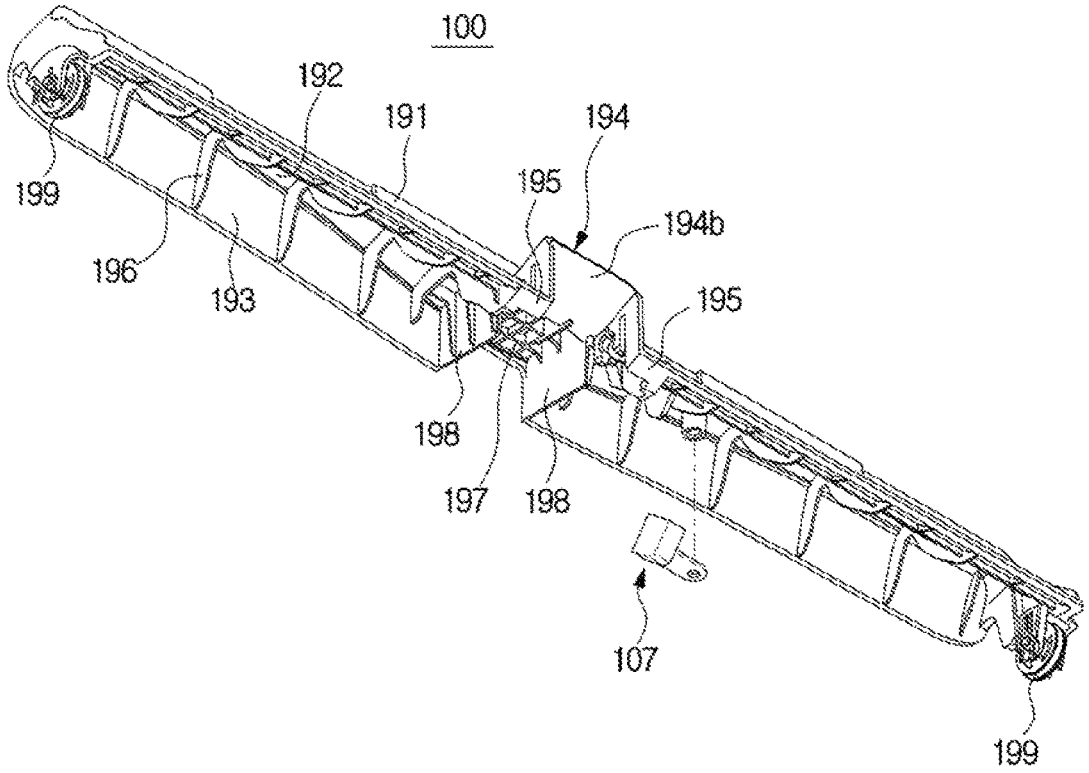
FIG. 16 is a view illustrating the deflection member shown in FIG. 15.
Figure 17:
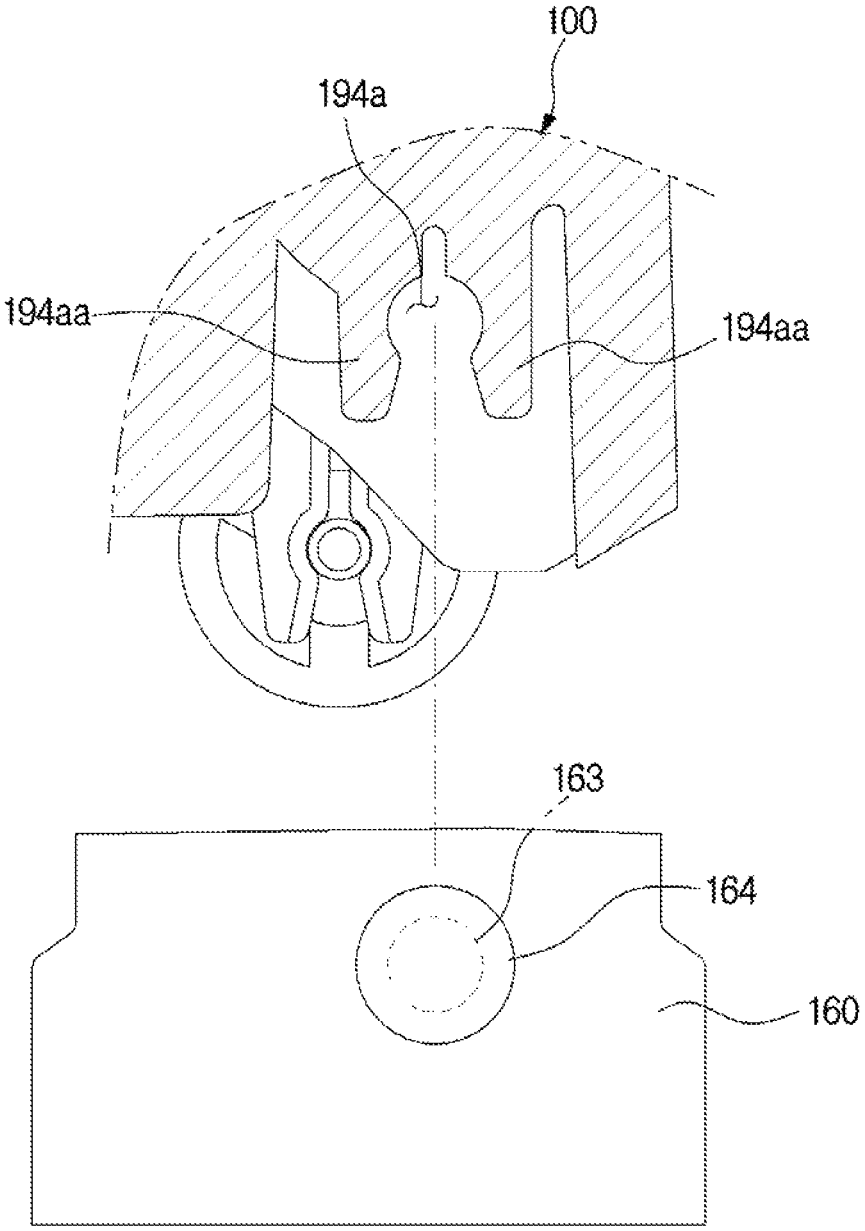
FIG. 17 is an enlarged view illustrating parts of the deflection member and the vane holder of the dish washing machine shown in FIG. 1.

FIG. 15 is a view illustrating a deflection member 190 and the vane holder 160 of the dish washing machine 1 shown in FIG. 1. FIG. 16 is a view illustrating the deflection member 190 shown in FIG. 15. FIG. 17 is an enlarged view illustrating parts of the deflection member 190 and the vane holder 160 of the dish washing machine 1 shown in FIG. 1.

The vane 100 may include the vane holder 160 and the deflection member 190.

The vane 100 may include the vane holder 160 provided at an approximately central portion of the vane 100 and combined with an outside of the rail 121 to move the vane 100 to linearly reciprocate.

The vane holder 160 is connected to the direction changing member 180 and transfers a driving force of the belt 140 to the vane 100. The vane holder 160 is provided to surround an outer surface of the rail 121.

The vane holder 160 includes a rotating pin combining hole 161 with which the rotating pin 181 of the direction changing member 180 is rotatably combined. The rotating pin combining hole 161 may be provided at a bottom surface of the vane holder 160 considering the opening 126 formed at a bottom of the rail 121.

The vane holder 160 may include a combination protruding portion 162 provided to be separably combined with the vane 100. The combination protruding portion 162 may include a combination shaft portion 163 configured to laterally protrude and a separation preventing portion 164 formed at an end of the combination shaft portion 163 to prevent the vane 100 from deviating.

The deflection member 190 may be provided to elongate perpendicularly to the rail 121.

The deflection member 190 may include a deflecting portion 191 configured to deflect washing water sprayed from the fixed nozzle 55, an upper supporter 192 bent at the deflecting portion 191, a rear supporter 193 bent at the upper supporter 192, a cap portion 194 provided in an approximately central portion along a longitudinal direction of the deflecting portion 191, a rotation holding portion 195 provided to interfere with the rotation guide 75 of the bottom plate cover 70, a reinforcing rib 196 provided to reinforce strength of the deflecting portion 191, the upper supporter 192, and the rear supporter 193, a horizontal supporter 197 supported by a top surface of the vane holder 160, and a vertical supporter 198 supported by a side surface of the vane holder 160.

The deflecting portion 191 includes deflecting surfaces 191*a* and 191*b* provided to be tilted to deflect washing water. The deflecting surfaces 191*a* and 191*b* may include a first deflecting surface 191*a* and a second deflecting surface 191*b* alternately arranged along a longitudinal direction at different inclinations to make a deflection angle of washing water different.

The cap portion 194 may include a combination groove 194*a* for combination with the vane holder 160 and a rotation stopper 194*b* configured to limit a rotational range of the deflection member 190 when the deflection member 190 is rotated by the rotation guide 75 of the bottom plate cover 70.

The combination protruding portion 162 of the vane holder 160 may be combined with the combination groove 194*a* of the deflection member 190. In detail, the combination shaft portion 163 of the combination protruding portion 162 may be inserted into the combination groove 194*a* of the deflection member 190. The combination shaft portion 163 may rotatably support the deflection member 190.

As shown in FIG. 17, the combination groove 194*a* of the deflection member 190 may be formed by elastic hooks 194*aa*. The elastic hooks 194*aa* may be elastically deformed in a direction of being spaced apart again during a process of inserting or withdrawing the combination shaft portion 163 of the vane holder 160 into or from the combination groove 194*a* of the deflection member 190 and may be restored to an original shape when insertion or separation is completed. Through such configuration described above, the deflection member 190 may be mountable on or separable from the vane holder 160.

Rollers 199 configured to smoothly move the vane 100 may be provided at both longitudinal ends of the deflection member 190. A roller supporter (not shown) configured to support the rollers 199 may be provided at the bottom plate 35 of the washing tub 30.

The deflection member 190 may include a magnet accommodation portion 107 in which a magnet (not shown) sensed by the sensor 106 configured to check whether the vane 100 normally operates is accommodated. The magnet accommodation portion 107 may be cut at a portion configured to face the sensor 106 to operate due to a certain magnetic force.

The magnet accommodation portion 107 may be combined with the deflection member 190 through a fastening hole while accommodating the magnet therein. The magnet accommodation portion 107 may be provided to be positioned above the sensor 106 provided at the bottom plate cover 70. According to such configuration described above, the sensor 106 may sense when the vane 100 approaches to check whether the vane 100 normally operates.

As described above, since the dish washing machine 1 according to the present disclosure is capable of moving the vane 100 to reciprocate using a relatively simple configuration, manufacturing costs may be reduced. Also, since it is sensed whether the vane 100 malfunctions, reliability of driving may be ensured. In addition, since the belt 140 for moving the vane 100 to reciprocate is manufactured by injection-molding to integrate and then connecting through the connection member 143, strength thereof may be increased and manufacturing costs thereof may be reduced.

As apparent from the above description, a dish washing machine in accordance with the concept of the present disclosure may reduce manufacturing costs by driving a vane to reciprocate without an additional controller.

A dish washing machine in accordance with the concept of the present disclosure may reduce manufacturing costs by driving a vane to reciprocate using a motor rotatable in one direction.

A dish washing machine in accordance with the concept of the present disclosure may assure washing performance by checking whether a vane malfunctions through a sensor and may provide stability in use by preventing a water leakage.

A dish washing machine in accordance with the concept of the present disclosure may be manufactured by injection-molding a belt provided at a driving device of a vane and then connecting both ends thereof through a connecting member, thereby reducing manufacturing costs and stably driving the vane.

Although a few embodiments of the present disclosure have been shown and described, it would be appreciated by those skilled in the art that changes may be made in these embodiments without departing from the principles and spirit of the present disclosure, the scope of which is defined in the claims and their equivalents.

What is claimed is:

1. A dish washing machine comprising:

a washing tub;

a nozzle to spray washing water;

a vane that linearly reciprocates in the washing tub and deflects the washing water sprayed from the nozzle as the vane linearly reciprocates;

a driving source that generates power;

a belt that rotates in a rotation direction via the power generated by the driving source; and a direction changing member having one end combined with the vane and being rotatable with respect to the vane, and another end fixed to, or integrated with, the belt, so that, as the belt rotates in the rotation direction, the vane linearly reciprocates together with the direction changing member in a first direction, without the one end rotating with respect to the vane, until the one end reaches a position at which the one end rotates with respect to the vane and thereby causes the vane to linearly reciprocate together with the direction changing member from the position in a second direction opposite to the first direction.

2. The dish washing machine of claim 1, further comprising:

a rail; and a vane holder that moves along the rail to guide the linear reciprocation of the vane, wherein the one end of the direction changing member is a rotating pin rotatably combined with the vane holder, to thereby be combined with the vane, the another end of the direction changing member is a fixed portion fixed to the belt, and the direction changing member further comprises a rotating portion connecting the fixed portion to the rotating pin.

3. The dish washing machine of claim 1, wherein the another end of the direction changing member is integrated with the belt.

4. The dish washing machine of claim 1, further comprising:

a gear coupled with the belt to transfer the power generated by the driving source to the belt to rotate the belt, wherein, when the one end of the direction changing member reaches the position, the direction changing member traverses the gear which thereby causes the one end to rotate with respect to the vane, and thereby causes the vane to linearly reciprocate together with the direction changing member from the position in the second direction.

5. The dish washing machine of claim 4, wherein when the one end of the direction changing member is at the position, an axis of rotation of the one end coincides with an axis of rotation of the gear.

6. The dish washing machine of claim 4, wherein the first direction is one of a front-to-rear direction and a rear-to-front direction of the washing tub, and the second direction is the other of the front-to-rear direction and the rear-to-front direction.

7. The dish washing machine of claim 1, further comprising:

a first gear connected to the driving source; and a second gear connected to the first gear, wherein the first gear and the second gear engage with each other to transfer the power generated by the driving source to the belt to thereby rotate the belt, and when the one end of the direction changing member reaches the position, an axis of rotation of the one end coincides with an axis of rotation of the second gear, and the direction changing member traverses the second gear which thereby causes the one end to rotate with respect to the vane, and thereby causes the vane to linearly reciprocate together with the direction changing member from the position in the second direction.

8. The dish washing machine of claim 1, wherein the driving source comprises a unidirectional rotation motor to generate the power to rotate the belt, so that the belt only rotates in one direction.

9. The dish washing machine of claim 1, further comprising a sensor configured to sense whether the vane normally operates.

10. The dish washing machine of claim 9, wherein the vane comprises a magnet accommodation portion that accommodates a magnet, and the sensor comprises a hall sensor configured to sense the magnet, to thereby sense whether the vane normally operates.

11. The dish washing machine of claim 9, wherein the sensor is provided close to the nozzle.

12. The dish washing machine of claim 1, wherein the belt comprises a plurality of power transfer portions that engage with a gear to transfer the power generated by the driving source to the belt to rotate the belt, a wire configured to connect some of the plurality of power transfer portions to one another, and a connection member configured to connect other of the plurality of power transfer portions, the wire and the some of the plurality of power transfer portions being injection molded together as a single body, and the connection member being a separate body from the single body.

13. The dish washing machine of claim 12, wherein the plurality of power transfer portions comprise concave portions rotatably combined with the connection member.

14. The dish washing machine of claim 12, wherein the another end of the direction changing member is fixed to at least one of the plurality of power transfer portions.

15. The dish washing machine of claim 12, wherein the another end of the direction changing member has a shape of the plurality of power transfer portions.

16. The dish washing machine of claim 4, wherein:

the vane travels along a travel path as the vane linearly reciprocates, the vane includes a magnet accommodation portion to accommodate a magnet, and the dish washing machine further comprises a sensor to sense the magnet and thereby determine whether the vane deviates from the travel path.

17. The dish washing machine of claim 16, wherein the sensor is provided close to the nozzle.

18. The dish washing machine of claim 1, wherein the belt has a first rotational movement section and a second rotational movement section, the dish washing machine includes a driving gear to transfer the power generated by the driving source to the belt to rotate the belt and being engaged with the first rotational movement section, and an idle gear engaged with the second rotational movement section, in the first rotational movement section, the one end of the direction changing member rotates about a rotational center of the driving gear and the another end of the direction changing member rotatably moves along an outer circumference of the driving gear, in the second rotational movement section, the one end of the direction changing member rotates about a rotational center of the idle gear and the another end of the direction changing member rotatably moves along an outer circumference of the idle gear.

19. A dish washing machine comprising:

a washing tub;

a nozzle to spray washing water;

a vane that linearly reciprocates in the washing tub and deflects the washing water sprayed from the nozzle as the vane linearly reciprocates;

a driving source to generate power;

an idle gear;

a driving gear unit including a gear;

a belt connected to the gear included in the driving gear unit and the idle gear to rotate in a rotation direction via the power generated by the driving source transferred to the belt by the driving gear unit, to cause the vane to linearly reciprocate; and a direction changing member rotatably combined with the vane to rotate with respect to the vane so that, as the belt rotates in the rotation direction, the vane linearly reciprocates in a first direction until the direction changing member traverses the idle gear or the gear included in the driving gear unit, which causes the direction changing member to rotate with respect to the vane and thereby causes the vane to linearly reciprocate in a second direction opposite to the first direction.

20. A dish washing machine comprising:

a nozzle to spray water;

a vane to deflect the sprayed water;

a belt;

a gear coupled with the belt to transfer power generated by a motor to the belt to cause the belt to rotate in a rotation direction; and a direction changing member having a first portion combined with the vane so that the first portion is rotatable with respect to the vane, and a second portion fixed to, or integrated with, the belt, wherein the belt, the gear and the direction changing member operate together so that the vane linearly reciprocates together with the direction changing member in a first direction toward the gear due to the rotation of the belt in the rotation direction while the vane deflects the sprayed water, and, after the vane together with the direction changing member reach the gear due to the rotation of the belt in the rotation direction, the direction changing member traverses the gear which causes the first portion to rotate with respect to the vane, without the vane being rotated, to thereby cause the vane together with the direction changing member to linearly reciprocate away from the gear in a second direction opposite the first direction due to the rotation of the belt in the rotation direction while the vane deflects the sprayed water.

* * * * *